United States Patent [19]

Ahs

[11] Patent Number: 4,868,530

[45] Date of Patent: Sep. 19, 1989

[54] ELECTRONIC SWITCH

[75] Inventor: Wilgot Åhs, Koppom, Sweden

[73] Assignee: Tocksfors Verkstads AB, Tocksfors, Sweden

[21] Appl. No.: 246,943

[22] Filed: Sep. 20, 1988

Related U.S. Application Data

[63] Continuation of Ser. No. 56,689, Jun. 2, 1987, abandoned.

[30] Foreign Application Priority Data

Jan. 15, 1987 [SE] Sweden ..... 8700144

[51] Int. Cl.[4] ..... H01H 9/00

[52] U.S. Cl. ..... 335/207; 200/404

[58] Field of Search ..... 335/205–207; 200/67 F

[56] References Cited

U.S. PATENT DOCUMENTS

| | | | |
|---|---|---|---|
| 3,273,091 | 9/1966 | Wales, Jr. | 200/67 F |
| 3,723,923 | 3/1973 | Suzuki | 335/81 |
| 4,054,944 | 10/1977 | Lau | 200/67 F |
| 4,199,741 | 4/1980 | Paulet | 335/207 |
| 4,330,771 | 5/1982 | McGovern | 335/205 |

*Primary Examiner*—E. A. Goldberg
*Assistant Examiner*—Lincoln Donovan
*Attorney, Agent, or Firm*—Cushman, Darby & Cushman

[57] ABSTRACT

Electronic switch comprising an operating means (1;7;12;15;18) movable in the switch. The operating means has only one magnetic pole operative for its motion, said pole being arranged to coact without contact with at least one second magnetic pole of a second magnet (**5;5*a***) placed in the switch.

10 Claims, 3 Drawing Sheets

ELECTRONIC SWITCH

This is a continuation of application Ser. No. 07/056,689 , filed June 2, 1987, which was abandoned upon the filing hereof.

This invention relates to an electronic switch.

Various switches are known and the different constructions differ to ensure the function of the operating means or rocker arm and to maintain this in desired positions. Various types of springs such as helical springs and plate springs as well as slewing bracket systems are used to fulfill the functions of the operating arm or rocker arm. In many cases these relatively complicated constructions have been replaced by switches, the operating arm or rocker arm positions of which are defined by magnetic stop means coacting with magnetic materials in the operating means or rocker. These later constructions can be said to be a simplification of the first-mentioned, mechanical switches but are still restricted for use in connection with relatively predetermined functions as a substitute for the mechanical switches.

By the present invention, as apparent from the characterizing parts of the claims, there is an electronic switch having a contact-free switching function and a simple design and assembly and which, moreover, has no other movable parts than the very operating means. By means of the invention it is possible to vary the switching function in a plurality of manners and according to need, simultaneously as the switch will be very reliable and cheap in production.

Figure 1:
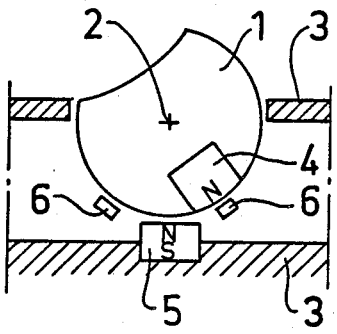
Figure 2:
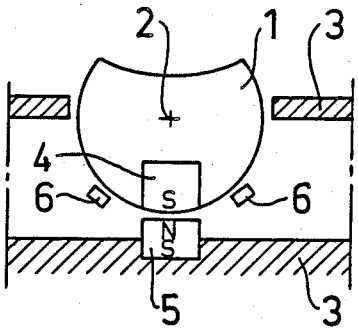
Figure 3:
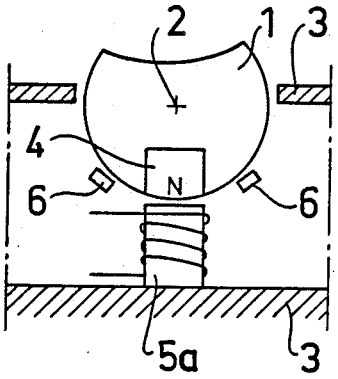
Figure 4:
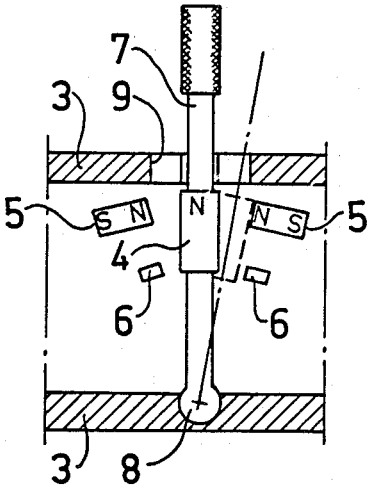
Figure 5:
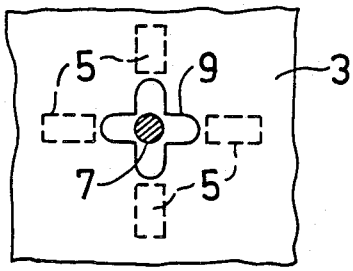
Figure 6:
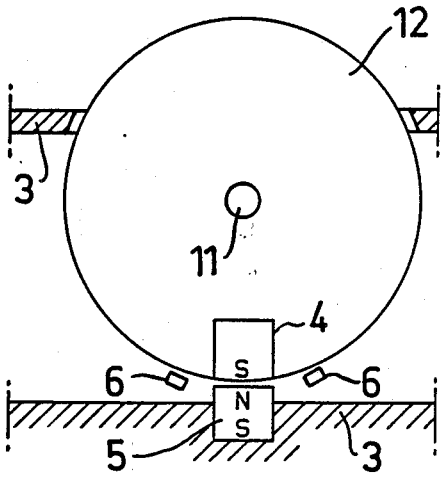
Figure 7:
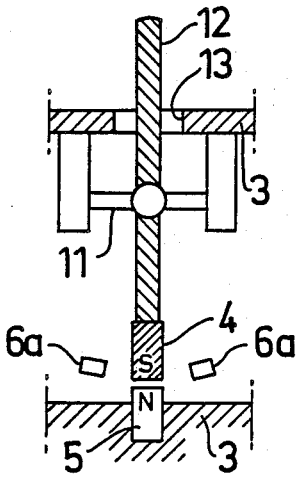
Figure 8:
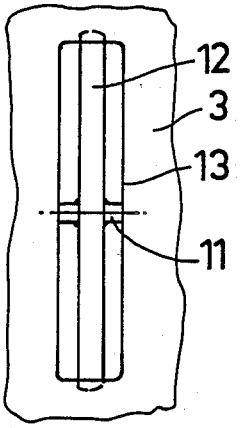
Figure 9:
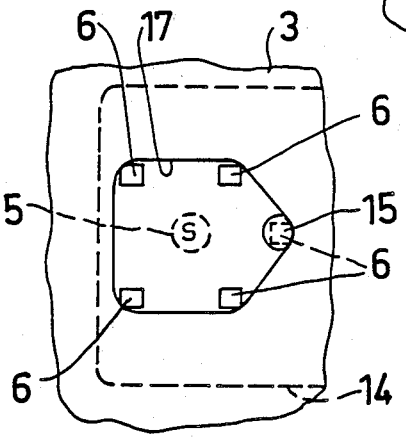
Figure 10:
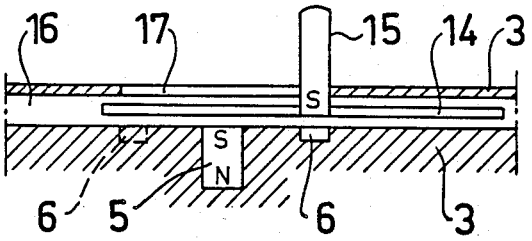
Figure 11:
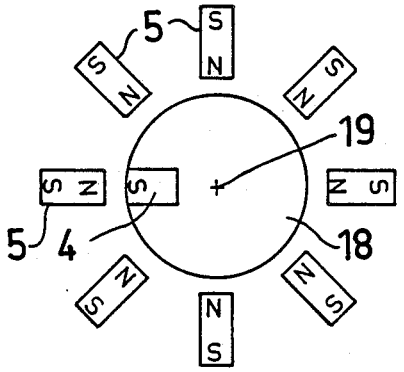
Figure 12:
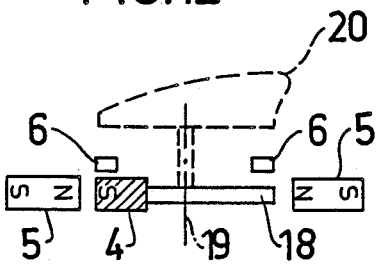
Figure 13:
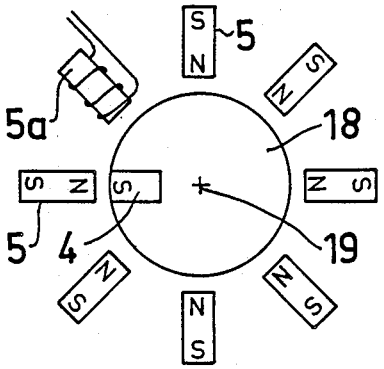

The invention will be described in greater detail in the form of examples with reference to the drawing, wherein FIGS. 1–3 show three different embodiments of an operating rocker according to the invention, FIGS. 4 and 5 show a lever-operated switch according to the invention as seen in a schematic, partial, lateral section and from above, FIGS. 6–8 show another embodiment of the switch according to the invention as seen schematically from the side in partial section from one end side and from above, respectively, FIGS. 9 and 10 show another embodiment of the switch of the invention as seen schematically from above and laterally in section, FIGS. 11 and 12 show another embodiment of the invention schematically from above and from the side, and FIG. 13 shows a further variant of the switch shown in FIGS. 11 and 12.

In FIGS. 1–3 an operating means 1 is shown in the form of a rocker rotatably mounted about a shaft 2, 3 designates schematically a casing or housing in which the rocker is mounted. The rocker has further a permanent magnet 4 so arranged in the rocker 1 that only one of its poles will have a possibility to coact with a second magnet 5 fixedly arranged in the casing 3. 6 denotes a magnetoresistive transducer, for example a Hall effect transducer.

According to FIG. 1 the permanent magnet 4 of the rocker 1 has its north pole turned outwards to coact with the north pole of the other magnet 5. This means that the rocker 1 can enter two stable positions, one of which is shown in FIG. 1 with the transducer 6 actuated by the magnet 4. It is to be understood that the other stable position is when the magnet 4 actuates the left transducer 6 (not shown). It is further to be understood that the movement of the rocker is limited by stop lugs or the like which are not shown for the sake of clearness.

According to FIG. 2 the magnet 4 of the rocker 1 is turned so that its south pole coacts with the north pole of the other magnet 5, the rocker having the stable position shown in the figure. By turning the rocker clockwise or anticlockwise the magnet 4 will actuate the respective transducer 6. As soon as the rocker 1 is released it will return to its stable position shown.

FIG. 3 shows a switch in which the other magnet 5 has the shape of an electromagnet, which coacts with the north pole of the permanent magnet 4 in the example shown. By reversing the direction of current in the electromagnet 5 its poles can change places and it is thus possible, when required, to obtain by the device shown in FIG. 3 the functions provided by each of the switches shown in FIGS. 1 and 2.

In FIGS. 4 and 5 a switch is shown in the form of an operating lever 7, one end 8 of which is articulatedly mounted at the casing 3. In the example shown (FIG. 5) the motion of the lever to two orthogonal directions is guided by a cross-like opening or coulisse 9. The operating lever 7 preferably having a grip portion 10 carries a permanent magnet 4 with its north pole turned upwards in the example shown. Four stationary other permanent magnets 5 are arranged on a level with the north pole of the magnet 4 and in the extensions of the coulisse legs, compare FIG. 5. The north poles of the permanent magnets 5 are facing the north pole of the magnet 4. This means that the operating lever has its position of rest straight in the coulisse 9, as shown in FIGS. 4 and 5. The operating lever 7 can be moved to four positions guided by the coulisse 9, in each of which the magnet 4 actuates a magnetoresistive transducer 6 arranged at each such position. Such an operating position is indicated by dashed lines in FIG. 4.

FIGS. 6–8 show a switch, the operating means of which has the shape of a control wheel 12 rotatable and rockable about a shaft 11. As mentioned in connection with FIGS. 1–3 stop means are arranged to restrict the torsional and rocking movements of the control wheel 12. For the sake of clearness these stop means are not shown. According to what is shown a permanent magnet 5 is fixedly arranged in the casing or housing 3 and has its north pole turned outwards (upwards). The control wheel 12, in turn, is provided with the permanent magnet 4 which is turned so that its south pole coacts with the north pole of the magnet 5. The stable position of the control wheel 12 is thus that shown in the figures. As is easily realized, the control wheel 12 can be turned clockwise or anti-clockwise about the shaft 11 and consequently actuate the one or the other of the magnetoresistive transducers 6. The control wheel 12 can also be tilted to actuate in this way magnetoresistive transducers **6*a*, see FIG. 7, arranged on each side of the disc 12. In the illustrative example shown the control wheel 12 extends partly through an elongate opening 13 in an upper portion of the housing 3**.

FIGS. 9 and 10 show a switch, the operating means of which has the shape of an operating disc 14 provided with an operating arm 15 and movable in its own plane in a space 16 of the casing 3 arranged for this. The operating arm 15 extends through an opening 17 made in one portion 3 of the casing, which aperture has five corners in the example shown, see FIG. 9. Moreover, in the casing 3 a permanent magnet 5 is arranged approximately straight below this opening with its south pole facing the opening. The operating arm 15 can form part of a permanent magnet which in the example shown has its south pole turned inwards towards the operating disc 14 and the part of the casing 3 supporting the magnet 5. In this part of the casing 3 magnetoresistive transducers 6 are also arranged in connection with the corners formed by the opening 17. Thus, the operating disc according to FIGS. 9 and 10 enters its positions of rest when the operating arm 15 is in any one of the corners formed by the opening 17, in which positions the respective transducer 6 is actuated by the permanent magnet (operating arm 15) of the disc 14.

The switch according to FIGS. 11 and 12 comprises a knob 18 mounted rotatably about a shaft 19. The knob supports a permanent magnet 4, the south pole of which is facing the periphery of the knob. A number of permanent magnets 5, the north poles of which are turned inwards towards the knob 18, are evenly distributed along the periphery of the knob 18. As is apparent from FIG. 12 magnetoresistive transducers 6 are fixedly arranged in a part of a housing or casing not shown on a level with each magnet 5 and for example above the knob 18. For the sake of clearness the transducers 6 have not been drawn in FIG. 11. The knob 18 can for instance be operated by means of a knob handle 20 indicated in FIG. 12. Thus, the knob at this switch can enter eight stable positions for eight different switching functions in the example shown. A similar switch is shown in FIG. 13 in which, however, one of the peripheral permanent magnets 5 has been replaced by an electromagnet 5*a*. By changing the direction of flow in the electromagnet 5*a* it is possible to change the holes of the magnet and in this way an instable position for the knob 18 can be obtained in case the south pole of the electromagnet 5*a* is facing the knob 18. In this connection it is to be understood that more than one and even all the permanent magnets 5 of course can be replaced by electromagnets or the poles of the permanent magnets 5 can be "mixed" depending on the desired function.

In the description made above the respective permanent magnet 4 (15) of the operating means has only been marked with one pole in the drawing figures but of course it is to be understood that each magnet has two poles. However, it is intended to stress that only one of the poles of the magnets is intended to be active for the function of the switch according to the invention. This should appear clearly from the above description. The quite constructive designs of a peripheral equipment such as casings, bearings, stop means, electric connections etc. have also been omitted for the sake of clearness.

Different embodiments of a switch based on the inventive idea have been described and it is obvious to one skilled in the art that a great number of switch forms and functions can be produced for many different purposes starting from the invention such as it is apparent from the following claims.

The illustrative examples have concerned magnetoresistive transducers, but of course it is realized that other transducers can also be used such as inductive switches, optic switches etc.

I claim:

1. An electronic switch comprising:

a switch housing;

a control element rotatably mounted in said housing, said control element having a first magnetic element mounted thereto; and at least a second magnetic element fixedly mounted to said housing and having a single pole thereof in facing relaqtion to said control element;

said first magnetic element being mounted to said control element such that a single pole thereof is operatively exposed and spaced from said single pole of each said second magnetic element so as to selectively interact therewith as said control element is angularly displaced whereby a stable angular disposition of said control element is defined.

2. The electronic switch of claim 1, wherein the second magnetic element is a permanent magnet.

3. The electronic switch of claim 1, wherein the second magnetic element is an electromagnet having a variable pole formation in facing relation to said control element.

4. The electronic switch of claim 1, wherein the control element has the shape of a movably mounted lever and the switch has at least two stationary magnets, the poles of said at least two stationary magnets in facing relation to the operatively exposed pole of the control element being of the same polarity as the operatively exposed pole of the control element.

5. The electronic switch of claim 1, wherein the control element has the shape of a rotatable operating wheel which is rockable relative to a torsional shaft mounted within said housing and the operatively exposed pole of the control element is disposed in an area of periphery of the wheel and coacts with the second magnetic element, said second magnetic element having a pole in facing relation to said operatively exposed pole with a polarity opposite to said operatively exposed pole.

6. The electronic switch of claim 1, wherein the control element has the shape of a disc movable in a plane thereof, the motion of the disc being restricted by an aperture defined in said housing and provided with positions of rest for a stop means of the disc, a pole of the second magnetic element being disposed on one side of the disc and in the central area of the aperature, said operatively exposed pole of said control element being mounted adjacent the stop means.

7. The electronic switch of claim 6, wherein the stop means forms an operating handle of the control element and supports the operatively exposed magnetic pole thereof.

8. The electronic switch of claim 1, wherein the operatively exposed magnetic pole of the control element is disposed so as to be movable in a circular path, a plurality of additional magnets disposed along the circular path with a magnetic pole of each facing the operatively exposed magnetic pole of the control element.

9. The electronic switch of claim 8, wherein the poles of the additional magnets have a polarity opposite to the polarity of the operatively exposed magnetic pole of the control element.

10. The electronic switch of claim 8, wherein at least one of the additional magnets is an electromagnet having a variable pole formation in facing relation to said operatively exposed magnetic pole.

* * * * *